US006213590B1

(12) United States Patent
Fujii et al.

(10) Patent No.: US 6,213,590 B1
(45) Date of Patent: Apr. 10, 2001

(54) INKJET HEAD FOR REDUCING PRESSURE INTERFERENCE BETWEEN INK SUPPLY PASSAGES

(75) Inventors: Masahiro Fujii; Keiichi Mukaiyama; Hiroyuki Maruyama; Tadaaki Hagata; Ikuhiro Miyashita, all of Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/391,942

(22) Filed: Sep. 8, 1999

Related U.S. Application Data

(63) Continuation of application No. 08/424,929, filed on Apr. 19, 1995.

(30) Foreign Application Priority Data

Apr. 20, 1994 (JP) ..... 6-81899
Apr. 20, 1994 (JP) ..... 6-81900

(51) Int. Cl.[7] ..... B41J 2/04
(52) U.S. Cl. ..... 347/54
(58) Field of Search ..... 347/54, 68, 69, 347/70, 71, 72, 50, 40, 57, 94; 399/261; 361/700; 310/328–330

(56) References Cited

U.S. PATENT DOCUMENTS

| | | | |
|---|---|---|---|
| 4,158,847 | | 6/1979 | Heinzl et al. . |
| 4,346,388 | | 8/1982 | Wiley . |
| 4,380,770 | | 4/1983 | Maruyama . |
| 4,571,599 | | 2/1986 | Rezanka . |
| 4,620,198 | * | 10/1986 | Behun . |
| 4,697,193 | | 9/1987 | Howkins . |
| 5,124,717 | | 6/1992 | Campanelli et al. . |
| 5,177,504 | | 1/1993 | Ishii et al. . |
| 5,441,593 | * | 8/1995 | Baughman et al. . |
| 5,510,816 | | 4/1996 | Hosono et al. . |
| 5,513,431 | | 5/1996 | Ohno et al. . |
| 5,534,900 | | 7/1996 | Ohno et al. . |
| 5,563,634 | | 10/1996 | Fujii et al. . |
| 5,644,341 | | 7/1997 | Fujii et al. . |
| 5,646,662 | | 7/1997 | Kitahara . |
| 5,668,579 | | 9/1997 | Fujii et al. . |
| 5,734,395 | | 3/1998 | Kamisuki et al. . |
| 5,754,204 | | 5/1998 | Kitahara . |
| 5,894,316 | | 4/1999 | Sakai et al. . |

FOREIGN PATENT DOCUMENTS

| | | | |
|---|---|---|---|
| 0 479 441 | | 4/1992 | (EP) . |
| 0 500 068 | | 8/1992 | (EP) . |
| 0 580 283 | | 1/1994 | (EP) . |
| 52-49033 | | 4/1977 | (JP) . |
| 55-158981 | | 12/1980 | (JP) . |
| 62-8316 | | 2/1987 | (JP) . |
| 1-186331 | | 7/1989 | (JP) . |
| 4-345853 | | 12/1992 | (JP) . |
| 6-71882 | * | 3/1994 | (JP) ..... 347/68 |

* cited by examiner

*Primary Examiner*—John Barlow
*Assistant Examiner*—Raquel Yvette Gordon

(57) ABSTRACT

A high reliability ink jet head for an ink jet recording apparatus enabling consistent ink ejecting with no nozzle clogging. The ink jet head therefor comprises a substrate comprising plural ink passages, each comprising a nozzle, pressure generator continuous to the nozzle, and an orifice, and an ink supply member common to the plural ink passages. The substrate comprising an anisotropic crystalline material such as silicon, and a filter channel formed integrally to the ink supply member by anisotropic etching.

8 Claims, 14 Drawing Sheets

$$Ra = \frac{2n}{n} \int_o^l \frac{T^2(x)}{S^3(x)} dx$$

$$Ma = \frac{P}{n} \int_o^l \frac{1}{S(x)} dx$$

$$Mf = \frac{PLf}{Sf}$$

$$Rf = \frac{2nTf^2}{S^3f}$$

INKJET HEAD FOR REDUCING PRESSURE INTERFERENCE BETWEEN INK SUPPLY PASSAGES

CROSS REFERENCE TO RELATED APPLICATIONS

This application is a continuation of pending U.S. patent application Ser. No. 08/424,929, filed Apr. 19, 1995, of which is incorporated herein in its entirety by reference.

This application is related to the following commonly-assigned, applications:

"Ink-Jet Recording Apparatus and Method for Producing the Head Thereof," Ser. No. 07/757,691, filed on Sep. 11, 1991 by Yoshihiro Ohno, et al., issued as U.S. Pat. No. 5,534,900.

"Ink-Jet Recording Apparatus and Method for Producing the Head Thereof," Ser. No. 08/259,554, filed on Jun. 14, 1994 by Yoshihiro Ohno, et al., issued as U.S. Pat. No. 5,513,431.

"Inkjet Head Drive Apparatus and Drive Method, and a Printer Using These," Ser. No. 08/274,184, filed on Jul. 12, 1994 by Masahiro Fujii, et al., issued as U.S. Pat. No. 5,563,634.

"Inkjet Head Drive Apparatus and Drive Method, and a Printer Using These," Ser. No. 08/350,912, filed on Dec. 7, 1994 by Masahiro Fujii, et al., issued as U.S. Pat. No. 5,644,341.

"Ink-Jet Printer and Its Control Method," Ser. No. 08/259,656, filed on Jun. 14, 1994 by Masahiro Fujii, et al, issued as U.S. Pat. No. 5,668,579.

"Inkjet Head and Manufacturing Method Thereof," Ser. No. 08/477,681, filed on Jun. 7, 1995 by Mitsuro Atobe, et al.

"A Method For Producing an Electrostatic Actuator and an Inkjet Head Using It," Ser. No. 08/400,648 filed on Mar. 8, 1995, by Masahiro Fujii, et al.

"An Inkjet Recording Apparatus," Ser. No. 08/400,642 filed on Mar. 8, 1995, by Masahiro Fujii, et al., now abandoned.

BACKGROUND OF THE INVENTION

1. Field of the Invention

The present invention relates to an ink-on-demand ink jet recording apparatus, and to a manufacturing method for an ink jet head therefor.

2. Description of the Related Art

Ink jet printers offer numerous desirable features, including extremely quiet operation when printing, especially at high speed, a high degree of freedom in the choice of ink, and the ability to use low-cost plain paper. So-called "ink-on-demand" printer heads in which ink is ejected only when required during recording have become the mainstream because it is not necessary to recover ink ejected unnecessarily during recording.

The ink jet head disclosed in JP-B-8316/1987 is one type of ink-on-demand ink jet head according to the prior art. In this type of head, a filter disposed in the ink supply path of the ink jet head is formed simultaneously with the ink passage by a photo-etching process, resulting in an ink jet head comprising an internal filter enabling ink to be ejected stably. The filter prevents foreign particulate from partially or fully blocking the flow of ink in the ink jet head and various passages therein.

The cross-sectional area of the filter opening preventing penetration of foreign particulate into the ink jet head must be smaller than the cross-sectional area of the any other ink passages consisting of nozzles, ejection chambers, ink supply cavity, and orifices communicating with the ejection chambers and ink supply cavity. In the above-described ink jet head, however, the filter is formed simultaneously with the other ink passages by an isotropic etching method, and the depth of the filter is therefore substantially the same as the depth of the nozzles and the orifices. As a result, the size of foreign particulate passing through the filter may be the same size as the nozzle and orifices. The probability of a nozzle or orifices becoming clogged is therefore high, and it is not possible to completely prevent clogging of all nozzles and orifices. This characteristic has a tendency to reduce the print quality and ink jet head reliability.

Further, the following problems are presented by simply forming the filter inside the head as in the above ink jet head, and achieving such a head is difficult.

The ink supply cavity distributes or supplies the ink to the ejection chamber through the orifices, and simultaneously buffers or reduces the pressure caused by the back flow of ink from the ink ejection chambers when the ink is ejected from the nozzle.

When the inertance of the filter is high, the pressure caused by ink back flow from the ink ejection chambers when ink is ejected from the nozzle cannot be sufficiently absorbed or reduced. This characteristic has a tendency to cause a pressure increase in the ink supply cavity, introducing pressure interference between the other ink ejection chambers and causing ink to be ejected from the other nozzles for which the pressure generating means has not been operated (i.e., ink is ejected from non-driven nozzles). If the flow resistance of the filter channel is high, ink cannot be sufficiently supplied from the filter to the ink supply cavity. The ejected ink volume therefore drops, air is taken in from the nozzle, and consistent ink ejection cannot be assured. Additionally, when the ink volume of the ink supply cavity is low, pressure cannot be sufficiently absorbed or reduced. Pressure interference between the ink ejection chambers therefore occurs, as when the filter inertance is high, and ink is ejected from nozzles of which the pressure generating means has not been operated.

In each of these cases, print reliability drops because of missing, incompletely formed or extra pixels in the printed image, contributing to indefinite images, reading errors and reduced print quality.

When the filter is formed using glass or another isotropic material, the etching ratio is not stable, and it is difficult to manufacture an ink jet head in which the filter is formed easily and with good precision.

OBJECTS OF THE INVENTION

Accordingly, it is an object of the present invention to provide an ink jet recording head which overcomes the aforementioned problems.

It is another object of the present invention to provide an ink jet recording apparatus whereby clogging of the ink supply path by the inflow of foreign particulate is prevented, thereby eliminating dropped dots and improving reliability, and to provide a manufacturing method for an ink jet head therefor.

It is another object of the invention to provide an ink jet head and an ink jet recording apparatus whereby there is no pressure interference between ink supply paths. Ink supply deficiencies are thus eliminated to assure consistent ink ejection and good print quality.

It is an additional object of the invention to provide an ink jet head and an ink jet recording apparatus which are simple to manufacture, are low cost, and provide high dimensional precision and quality.

SUMMARY OF THE INVENTION

To achieve the aforementioned object, an ink jet recording apparatus according to the present invention comprises an ink jet head having a plurality of nozzle openings and a plurality of independent ejection chambers respectively communicating to each of said nozzle openings from which ink droplets are ejected according to the change in pressure generated by each ejection chamber. The apparatus further includes an ink cavity for storing ink, ink supplying paths which supply ink to each of the ejection chambers from the ink cavity and a filter formed in or attached to the ink cavity. The ejection chambers, the ink supplying paths, the ink cavity and the filter are formed together on an anisotropic crystalline substrate, such as a silicon substrate, and the filter has a plurality of channels, which are shallower than any of the other channels of the nozzles and ink supplying paths.

The filter is provided for preventing the introduction of foreign particulate to the ink chamber and to the nozzles. The filter also functions as inlet ports for supplying ink from an external source to the ink cavity.

The preferred shape of the filter is a cross-sectional area of the filter opening that is smaller than the cross-sectional area of the ink supply paths and the nozzles. In addition, the inertance of the filter is preferably a maximum one-fifth the inertance of the ink passage consisting of the ejection chambers and the ink supplying paths plus the corresponding nozzles; and the flow resistance of the filter is preferably a maximum one-fourth the flow resistance consisting of the ejection chambers and the ink supplying paths plus the corresponding nozzles. At least one wall of the ink cavity is also preferably flexible.

A method for producing an ink jet head according to the present invention comprises the step of at least anisotropic etching an anisotropic crystalline substrate on the first surface thereof to form at least a plurality of communicating channels delineating a plurality of independent ejection chambers, an ink cavity, ink paths, each of which connects with each of the ejection chambers and the ink cavity, and a filter connecting with the ink cavity. Next, by means of anisotropic etching, a group of adjacently disposed grooves with said filter is formed, each of which is shallower than the channels delineating the ejection chambers, the ink cavity and the ink paths, and nozzle openings each of which connects with each of the ejection chambers. Forming, by means of anisotropic etching, a plurality of diaphragms with each of the bottom walls of said ejection chambers and bonding a cover substrate to the first surface of the anisotropic crystalline substrate sealing the rims of ejection chambers, the ink cavity, the ink paths and the filter to enclose the same while maintaining the communication therebetween.

To form the actuator for driving the diaphragm, this manufacturing method further comprises a process for forming electrodes in the first surface of an insulating substrate, and bonding the insulating substrate to the second surface of the anisotropic crystalline substrate on the side opposite the first face thereof such that the electrodes are in opposition to the diaphragms with a gap therebetween. Alternatively, a process for adhesive bonding piezoelectric elements for deforming the diaphragms to the back side of the ejection chambers of the anisotropic crystalline substrate is provided.

By means of the invention thus described, ink supplied to the ink jet head is supplied through a filter disposed in the ink supply port and is stored in the ink cavity. The ink stored in the ink cavity is distributed through the ink supply paths to the respective ejection chambers. The pressure generating means is then driven according to the print data, thereby pressurizing the ink in the ejection chamber, and causing an ink drop to be ejected from the nozzle continuous to the pressurized ejection chamber.

Because the ink and cleaning solution used to clean the ink supply path during manufacture is supplied through the filter disposed in the ink supply port, foreign particulate larger than the cross-sectional area of the filter opening and suspended in the ink or cleaning solution is stopped from entering the ink supply paths by the filter, and is thus prevented from penetrating to the ink supply path downstream from the ink supply port. Any foreign particulate passing the filter can therefore be ejected from the nozzle because the cross-sectional area of the filter opening is less than the cross-sectional area of the nozzle opening and ink supply path, and clogging of the narrow nozzles is thus eliminated. Printing problems are thus eliminated because clogging of the ink passage is prevented, and a high reliability ink jet head can be obtained.

The pressure increase in the ink chamber caused by the pressure generated in the ejection chamber of the driven nozzles is also reduced because the filter inertance is preferably a maximum one-fifth the inertance of the ink passage from the nozzle to the supply port. The problems of pressure, more specifically pressure interference and cross talk between ejection chambers, produced by the driven nozzle transferring to a non-driven nozzle and causing ink to be ejected from the non-driven nozzle are thus eliminated.

In addition, sufficient ink can be supplied from the ink supply port to the ink passage downstream therefrom because the flow resistance of the filter is preferably a maximum one-fourth the flow resistance of the ink passage from the head nozzles to the ink supply path. An ink supply deficiency therefore does not occur, printing density does not drop during high speed ink jet head drive, and such printing problems as dropped pixels caused by inconsistent ejecting do not occur.

In addition, if at least one wall of the ink chamber is flexible, pressure generated by the ejection chamber of the driven nozzle can be sufficiently buffered and reduced, thereby eliminating cross talk caused by pressure interference between ejection chambers.

Other objects and attainments together with a fuller understanding of the invention will become apparent and appreciated by referring to the following description and claims taken in conjunction with the accompanying drawings.

BRIEF DESCRIPTION OF THE DRAWINGS

In the drawings wherein like reference symbols refer to like parts.

DESCRIPTION OF THE PREFERRED EMBODIMENTS

Figure 1:
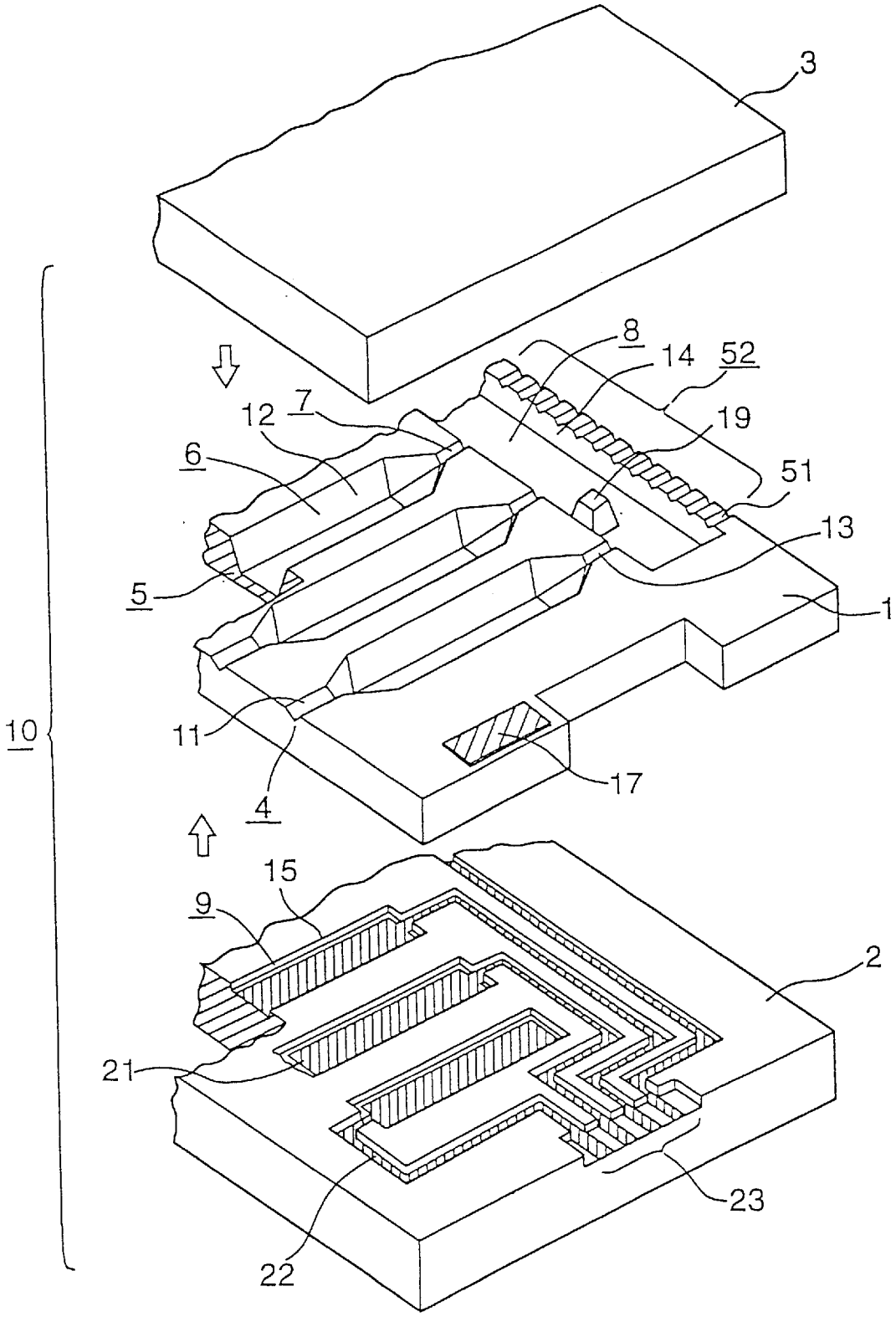
FIG. 1 is a partially exploded perspective view of an ink jet head according to the preferred embodiment of the present invention.

FIG. 1 is a partially exploded perspective view of an ink jet head according to the present invention. As shown therein, the ink jet head is an edge ejection type ink jet head whereby ink droplets are ejected from nozzles provided at the edge of the substrate. As will be appreciated by one of ordinary skill in are, the ink jet head may be implemented by a face ejection type ink jet head, whereby the ink is ejected from nozzles provided on the top surface of the substrate.

Referring specifically to FIG. 1, the ink jet head 10 in this embodiment is a laminated construction of three substrates 1, 2, 3 structured as described in detail below. The first and middle substrate 1 is arranged between substrates 2 and 3 and comprises a silicon wafer having plural parallel nozzle channels 11 formed on the surface of and at equal intervals from one edge of substrate 1 to form plural nozzles 4; corresponding recesses 12 in communication with a respective nozzle channel 11 and forming ejection chambers 6, which function as the pressure generating means and of which the bottom is diaphragm 5; orifice channels 13 functioning as the ink inlets and forming orifices 7 provided at the back of recesses 12; recess 14 forming common ink cavity 8, which is the ink supply member for supplying ink to each ejection chamber 6; and filter channels 52 forming filter 51 disposed at the back of recess 14.

Figure 3:
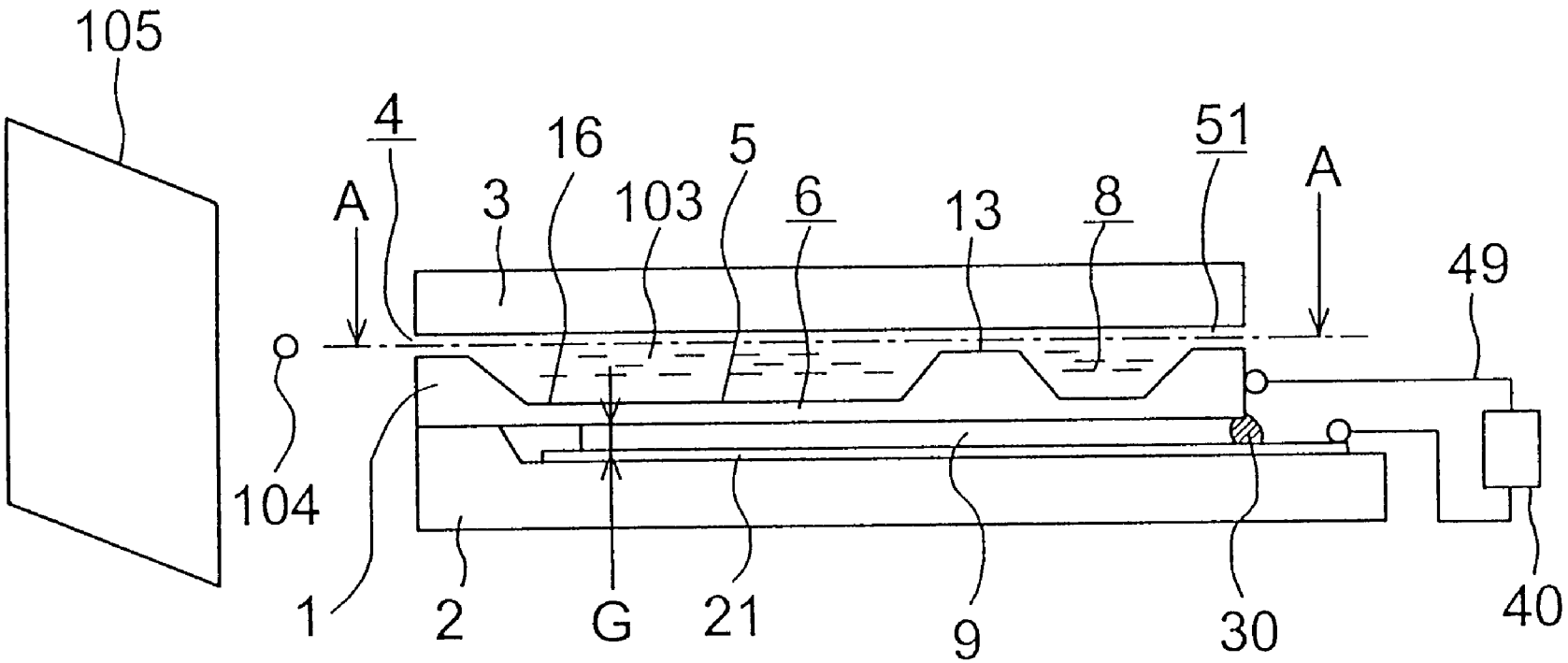
FIG. 3 is a side cross-sectional view of an ink jet head according to the preferred embodiment of the present invention.

Referring to FIGS. 1 and 3 in this embodiment, a gap holding means is formed by vibration chamber recesses 15 formed in second substrate 2 such that the gap between diaphragm 5 and the electrode disposed opposite thereto, i.e., length G (hereinafter the "gap length") of gap member 16, is the difference between the depth of recess 15 and the thickness of the electrode. It is to be noted that recesses may be alternatively formed in the bottom face of first substrate 1. In this embodiment, recess 15 is preferably etched to a depth of 0.3 $\mu$m. The pitch of nozzle channels 11 is preferably 0.509 mm, and the width is preferably 60 $\mu$m.

The relationship between the work functions of the semiconductor and metallic material used for the electrodes is an important factor affecting the formation of common electrode 17 to first substrate 1. In the present embodiment the common electrode is made from platinum over a titanium base, or gold over a chrome base, but the invention shall not be so limited and, as will be appreciated to one of ordinary skill in the art, other combinations may be used according to the characteristics of the semiconductor and electrode materials. For example, if substrate 1 is a p-type semiconductor, any materials whereby the work function of the common electrode material is greater may be used, and if substrate 1 is an n-type semiconductor, any materials whereby the work function of the common electrode material is less may be used.

Substrate 2 comprises borosilicate glass bonded to the bottom surface of first substrate 1. Vibration chambers 9 are formed in the top of second substrate 2, and recesses 15 comprising long, thin support member 35 are disposed in the middle of second substrate 2. Alternatively, support member 35 may not be provided if sufficient rigidity for ink ejecting is obtained by forming diaphragm 5 with sufficient thickness. It is preferable to provide support members now shown when the diaphragm is very thin. It is difficult to form diaphragms having about 5–10 $\mu$m thickness due to following reason. The diaphragm having 1–4 $\mu$m thickness can be obtained by forming an etch stop layer doped with high density boron and that a support member having a thickness greater than 10 $\mu$m can be obtained by keeping an etching time. So, it is difficult to obtain 5–10 $\mu$m thickness diaphragms precisely by applying conventional etching methods. The diaphragm produced by using an etch stop layer does not have sufficient rigidity for ink ejection. Therefore, the support member, that is shortened a span of a beam, is formed in the vibration chamber. On other hand, the diaphragm having above 10 $\mu$m thickness preferably does not require the support member.

In the preferred embodiment, a gap holding means is formed by vibration chamber recesses 15 formed in the top surface of second substrate 2 such that the gap between diaphragm 5 and the individual electrode disposed opposite thereto, i.e., length G (see FIG. 3; hereinafter the "gap length") of gap member 16, is the difference between the depth of recess 15 and the thickness of the electrode 21. It is to be noted that recesses 15 may be formed in the bottom of first substrate 1 as an alternative embodiment of the invention. In the present embodiment, recess 15 is etched to a depth of 0.3 $\mu$m. The pitch of nozzle channels 11 is 0.2 mm, and the width is 80 $\mu$m.

In the preferred embodiment, this bonding of second substrate 2 forms vibration chamber 9. Moreover, individual electrodes 21 are formed by sputtering gold on second substrate 2 at positions corresponding to diaphragm 5 to a 0.1 $\mu$m thickness in a pattern surrounding support members and essentially matching the shape of diaphragms 5. Individual electrodes 21 comprise a lead member 22 and a terminal member 23. Terminal member 23 is provided for connecting to external driving circuits. It will be appreciated by those skilled in the art that while electrodes 21, 22 and 23 preferably consist of gold, other suitable materials, such as ITO or another conductive oxide film, may be substituted therefor.

The third and top substrate 3 comprises borosilicate glass and is bonded to the top surface of first substrate 1. Nozzles 4, ejection chamber 6, orifices 7, and ink cavity 8 are formed by this bonding of third substrate 3 to first substrate 1. Support member 19 providing reinforcement is also provided in ink cavity 8 to prevent collapsing recess 14 when first substrate 1 and third substrate 3 are bonded together.

First substrate 1 and second substrate 2 are anodically bonded at 300~500° C. by applying a 500~1000–V charge. First substrate 1 and third substrate 3 are then bonded under the same conditions to assemble the ink jet head, as shown in FIG. 3. After anodic bonding, gap length G formed between diaphragms 5 and individual electrodes 21 on second substrate 2 is defined as the difference between the depth of recess 15 and the thickness of individual electrodes 21, and is 0.2 μm in this embodiment. A silicon oxide film is then formed preferably by thermal oxidation on the surface of diaphragm 5 in substrate 1. This process forms an insulation layer preventing short-circuit breakdown if electrode 21 contacts diaphragm 5. Field strength will be low if the thermal oxidation insulation film is too thick, and dielectric breakdown as a result of repeated field stress is facilitated if the film is too thin. This thermal oxidation film is therefore preferably 0.13 μm thick in this embodiment.

Figure 2:
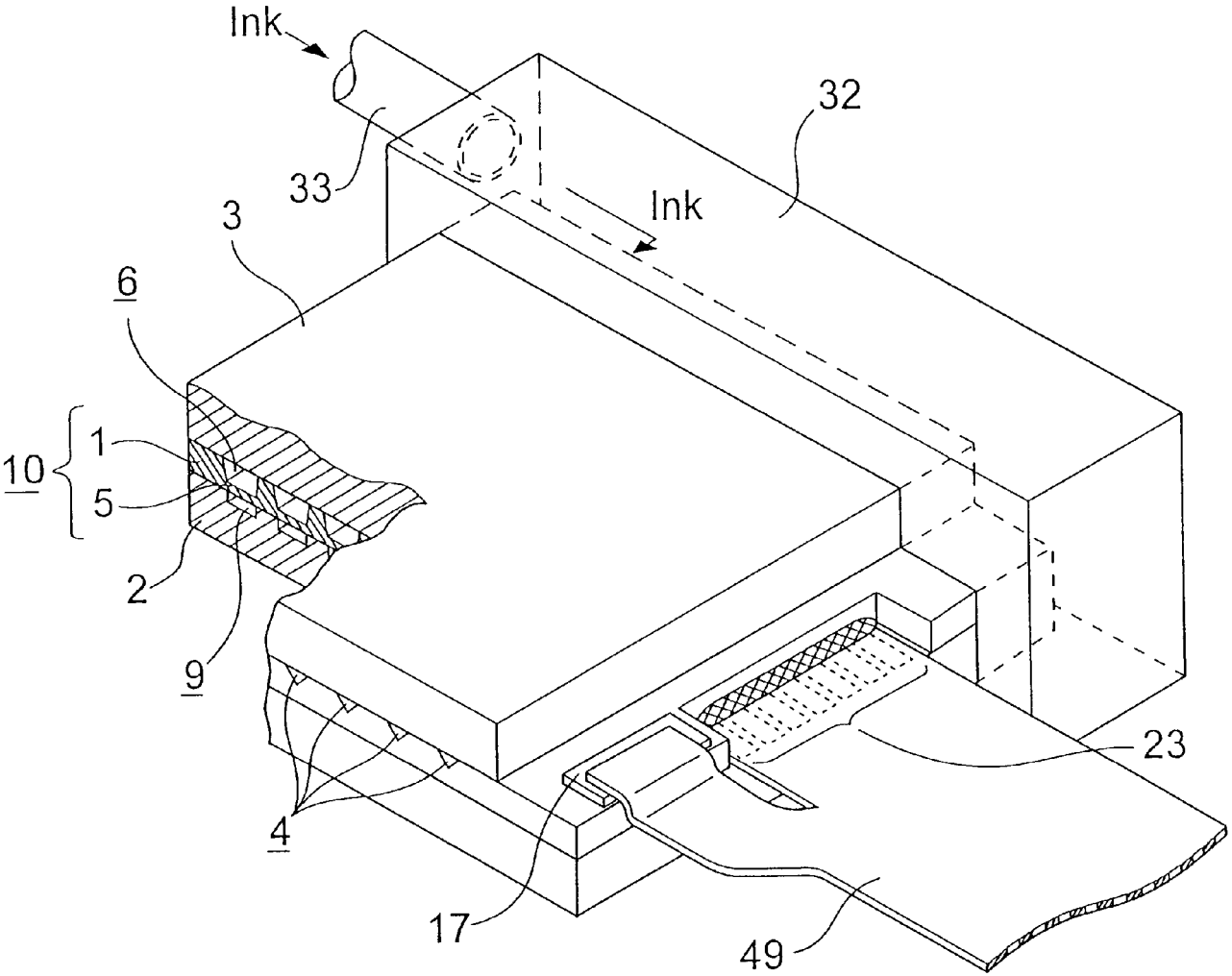
FIG. 2 is a perspective view of an ink jet head according to the preferred embodiment of the present invention.

Referring to FIGS. 2 and 3, after thus assembling the ink jet head, drive circuit 40 is connected by connecting flexible printed circuit (FPC) 49 between common electrode 17 and terminal members 23 of individual electrodes 21, thus forming an ink jet printer. Ink 103 is supplied from the ink tank (not shown in the figures) through tube 33 and common header 32 through filter 51 into first substrate 1 to fill common ink cavity 8 and ejection chambers 6. Upon application of a driving signal by drive circuit 40 to an individual electrode 21, the ink in ejection chamber 6 becomes ink drop 104 ejected from nozzles 4 and printed to recording paper 105 when ink jet head 10 is driven.

Figure 4:
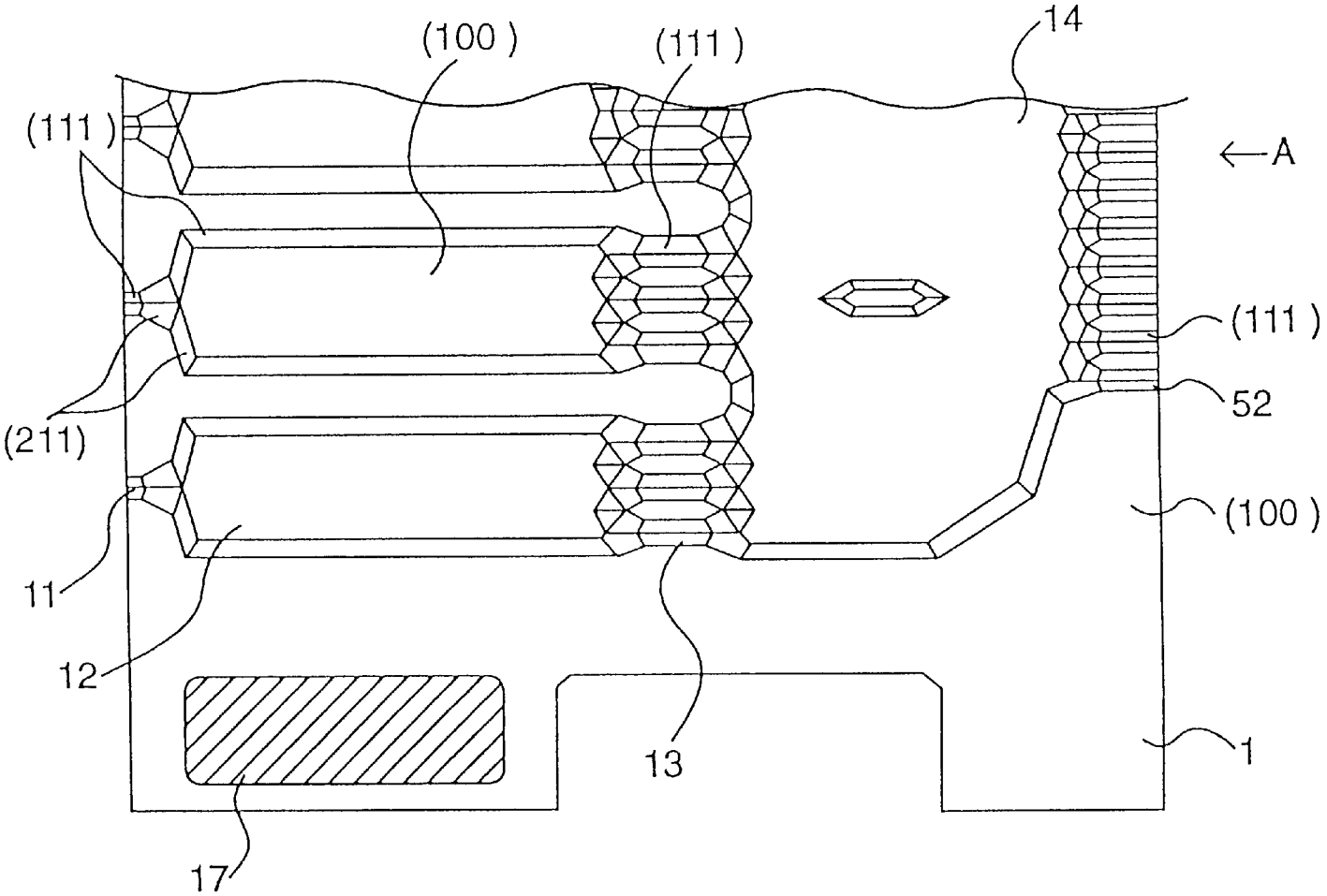
FIG. 4 is an enlarged plan view of a substrate of the ink jet head according to the preferred embodiment of the present invention.

FIG. 4 is an enlarged partial cross-sectional view of substrate 1. Substrate 1 of an ink jet head according to the present embodiment is manufactured by anisotropic etching of a single crystal silicon substrate. Anisotropic etching is an etching processing in which the etching speed varies according to the etching direction. The etching speed of face (100) in single crystal silicon is approximately forty times that of face (111), and this is used to form nozzle channels 11, recesses 12, orifice channels 13, recess 14, and filter channels 52 in the present embodiment.

Nozzle channels 11, orifice channels 13, and filter channels 52 are formed as V-shaped grooves from faces (111) where the etching speed is slower, resulting in the nozzle channels 11, orifice channels 13, and filter channels 52 having a triangular cross section. Nozzle channels 11 are 60 μm wide at the base of the triangle. Orifice channels 13 form three parallel flow channels, each width of which is 55 μm. Filter channels 52 are 50 μm wide, and 54 parallel filter channels 52 are formed in communication with recess 14.

Recesses 12 and 14 are trapezoidal channels of which the bottom is face (100) and the sides are face (111). The depth of recesses 12 and 14 is controlled by adjusting the etching time. The V-shaped nozzle channels 11, orifice channels 13, and filter channels 52 are shaped only by face (111), which has the slower etching speed, and the depth is therefore controlled by the channel width independent of the etching time.

These nozzle channels 11, orifice channels 13, and filter channels 52 are extremely sensitive contributors to the ink eject volume and speed characteristics of the ink jet head, and require the highest processing precision. In the present embodiment, those parts requiring the highest processing precision are made using the faces with the slowest etching speed by means of anisotropic etching, making it possible to obtain channels of different dimensions with high precision.

As described above, the width of the filter channels 52 is made narrower than the width of the nozzle channels 11 and orifice channels 13, thereby assuring that the cross-sectional area of the openings for the filter 51 formed inside the ink passage by bonding the third substrate to the first substrate will have the smallest cross-sectional area of any part of the ink passage. As a result, foreign particulate that could clog the nozzles 4 or orifices 7 is reliably blocked by the filter 51 from entering the ink passage. A major factor in dropped pixels and other printing defects is thus eliminated, and the reliability of the ink jet head can be assured. Production yield is also improved, and an ink jet head that can be easily mass produced can be obtained, because blockage of the nozzle holes and orifices during ink jet head production can be prevented.

Figure 5A:
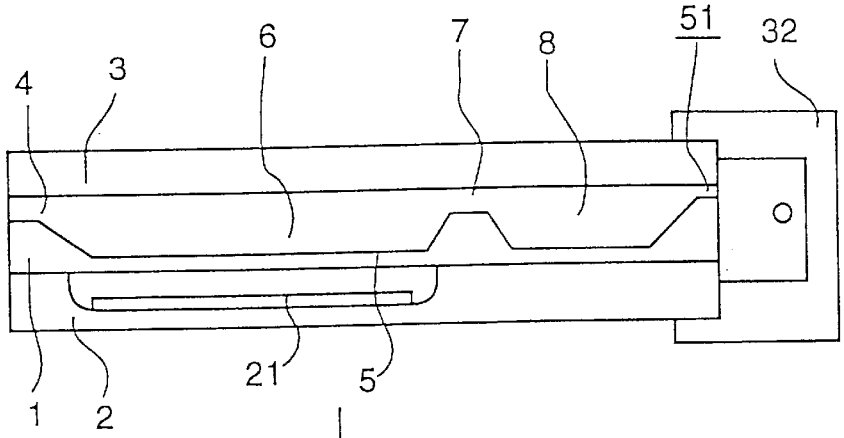
FIGS. 5A–5C are side cross-sectional views showing the ink eject operation of an ink jet head according to the preferred embodiment of the present invention.
Figure 5B:
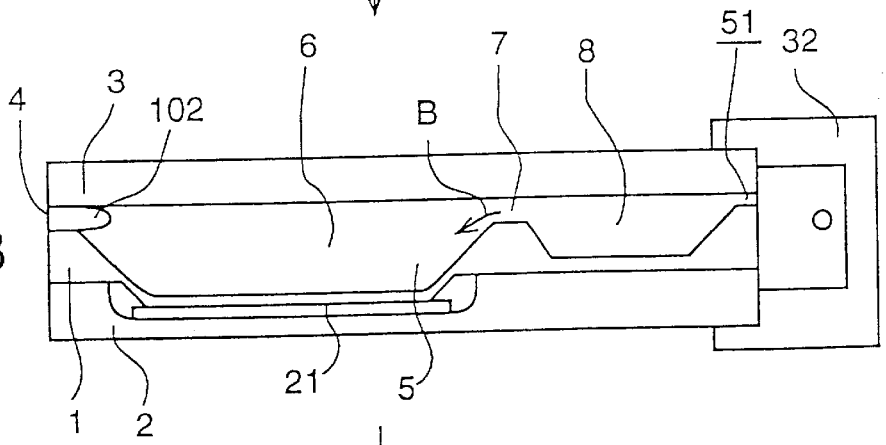
Figure 5C:
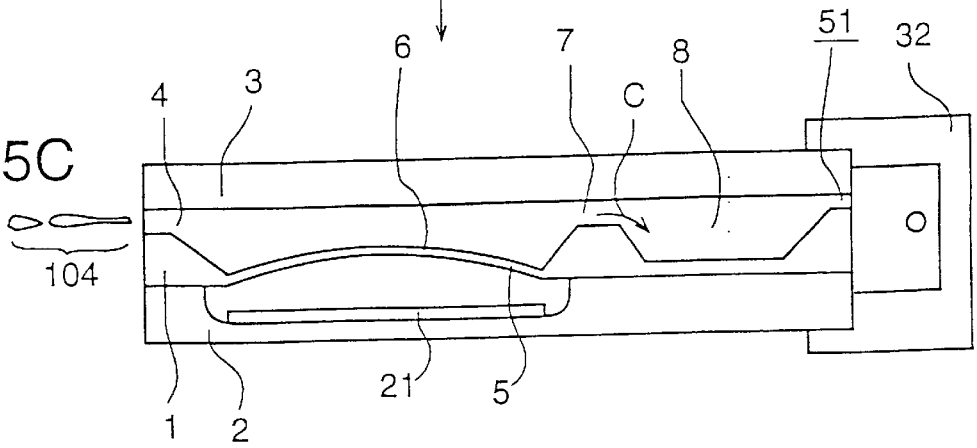
Figure 6A:
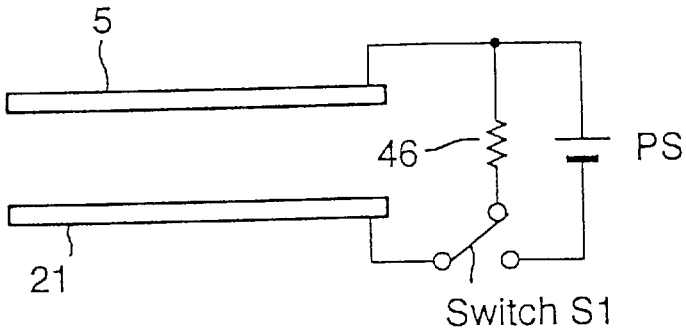
FIGS. 6A–6C are simplified illustrations of the effects when voltage is applied between the diaphragm and electrode of the ink jet head shown in FIGS. 5A–5C.
Figure 6B:
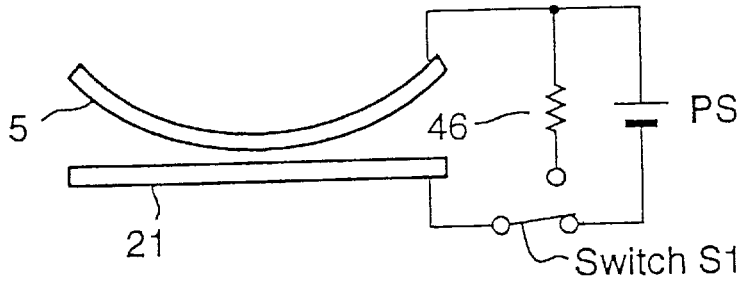
Figure 6C:
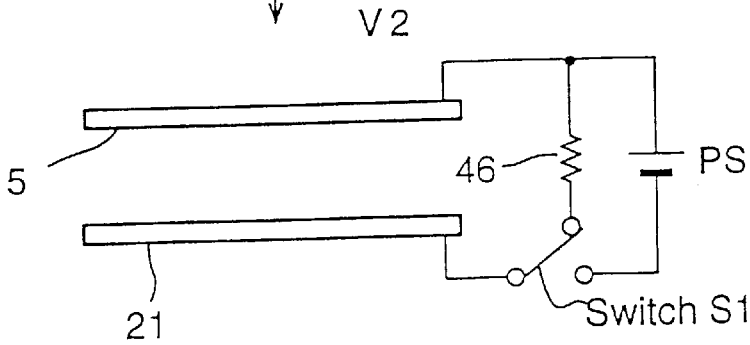

FIGS. 5A–5C are side cross-sectional views of an ink jet head according to the preferred embodiment of the invention, and are used below to describe the process whereby the diaphragm is deformed from the standby position to cause ink to be ejected from the nozzle. FIGS. 6A–6C are simplified illustrations depicting the effects of a voltage being applied between the diaphragm and electrode in the corresponding states shown in FIGS. 5A–5C. An example of ink jet head operation according to the present invention is described below with reference to FIGS. 5A–5C and 6A–6C.

FIG. 5A is a side cross-sectional view of the ink jet head in the standby state, and FIG. 6A illustrates the potential between diaphragm 5 and individual electrode 21 at that time. As can be seen therein, switch S1 is set such that common electrode 5 is electrically connected to individual electrode 21 resistor 46. In this arrangement a potential that has previously formed is effectively discharged. The ink jet head is in the standby state at this time, i.e., the ink passage is filled with ink and the ink jet head is ready to eject ink. When switch S1 is moved to its second position, electrodes 5 and 21 are connected to power supply PS and thus a voltage is applied between diaphragm 5 and individual electrode 21 in the standby state to create a potential difference as shown in FIG. 6B. The force of electrostatic attraction acts on diaphragm 5 and individual electrode 21 results from this potential difference, causing diaphragm 5 to be pulled toward individual electrode 21. The attraction of diaphragm 5 to individual electrode 21 at this time causes the pressure inside ejection chamber 6 to drop as shown in FIG. 5B, and ink is supplied in the direction of arrow B from common ink cavity 8 to ejection chamber 6. The meniscus 102 formed by nozzle 4 at this time is also pulled toward ejection chamber 6. Next, as shown in FIG. 6C, switch S1 is placed in its initial position at the timing whereby sufficient ink is supplied to ejection chamber 6, and the charge stored to diaphragm 5 and individual electrode 21 is discharged through resistor 46, diaphragm 5 is released by the field strength and returned into ejection chamber 6 by its inherent restoring force. The return of diaphragm 5 increases the pressure in ejection chamber 6, thus causing ink dot 104 to be ejected from nozzle 4, and the remaining ink in the ejection chamber 6 to be returned in the direction of arrow C through orifice 7 to common ink cavity 8, as shown in FIG. 5C. The oscillation of ink in the ink passage is buffered and converged by the flow resistance, and diaphragm 5 returns to the standby position shown in FIG. 5A and is ready for the next ejection operation.

In the above drive method, the diaphragm is not deformed in the standby state and is only deformed when driven, thus releasing the force applied to the diaphragm immediately after the pressure inside the ejection chamber is reduced, thus causing the pressure inside the ejection chamber to rise and ejecting an ink drop from the nozzle (a so-called "pull-push-ejection" method). It is to be noted that a so-called "push-ejection" method whereby the diaphragm is constantly deformed in the standby state and released only during ink jet head drive to eject ink may be alternatively used. The "pull-push-ejection" method described in the present embodiment provides a greater ink eject volume and improved frequency characteristics. It is to be further noted that the action and effect of the present invention are the same even if the drive force and drive method differ.

The channel constants of the ink jet head according to the present embodiment are described next.

Various properties of the ink passage of an ink jet head are determined by the viscosity and density of the ink combined with the cross-sectional area perpendicular to the ink flow line, the circumference of the flow line, and the length of the ink passage.

Inertance M is defined as:

$$M = \frac{\rho L}{S} \quad [1]$$

where ρ is the ink density, L is the length of the channel, and S is the cross-sectional area perpendicular to the flow line of the channel.

Inertance M is the resistance to the volume acceleration of ink; the greater the inertance M, the greater the resistance to acceleration and such forces as the generated pressure.

The flow resistance R is defined as:

$$R = \frac{2\eta T^2 L}{S^3} \quad [2]$$

where η is the ink viscosity, and T is the cross-sectional circumference of the channel. This value indicates the resistance to the volume velocity of the ink; the greater the flow resistance R, the greater the resistance to ink flow.

The ink compliance C is defined as:

$$C = \frac{W}{c^2 \rho} \quad [3]$$

where c is the speed of sound through the ink, and W is the volume of the ink passage. The ink compliance C indicates the deformation resistance of the ink; the greater the ink compliance C, the easier the ink deforms, i.e., the greater the ability of the ink to buffer pressure changes.

These various ink channel constants are adjusted to control the balance between the constants and assure consistent ink ejecting.

Common ink cavity 8 and filter 51 also have a specific inertance, flow resistance, and ink compliance. Using the drive method of the present embodiment described with reference to FIGS. 5A–5C and 6A–6C above, the inertance, flow resistance, ink compliance, and other channel constants of common ink cavity 8 and filter 51 are determined relative to the channel constants of the ink passage to prevent ink supply deficiencies and cross talk (pressure interference between ink passages) causing ink to be ejected from non-driven nozzles.

An example of the channel constants set for common ink cavity 8 and filter 51 is described in detail below.

Figure 7:
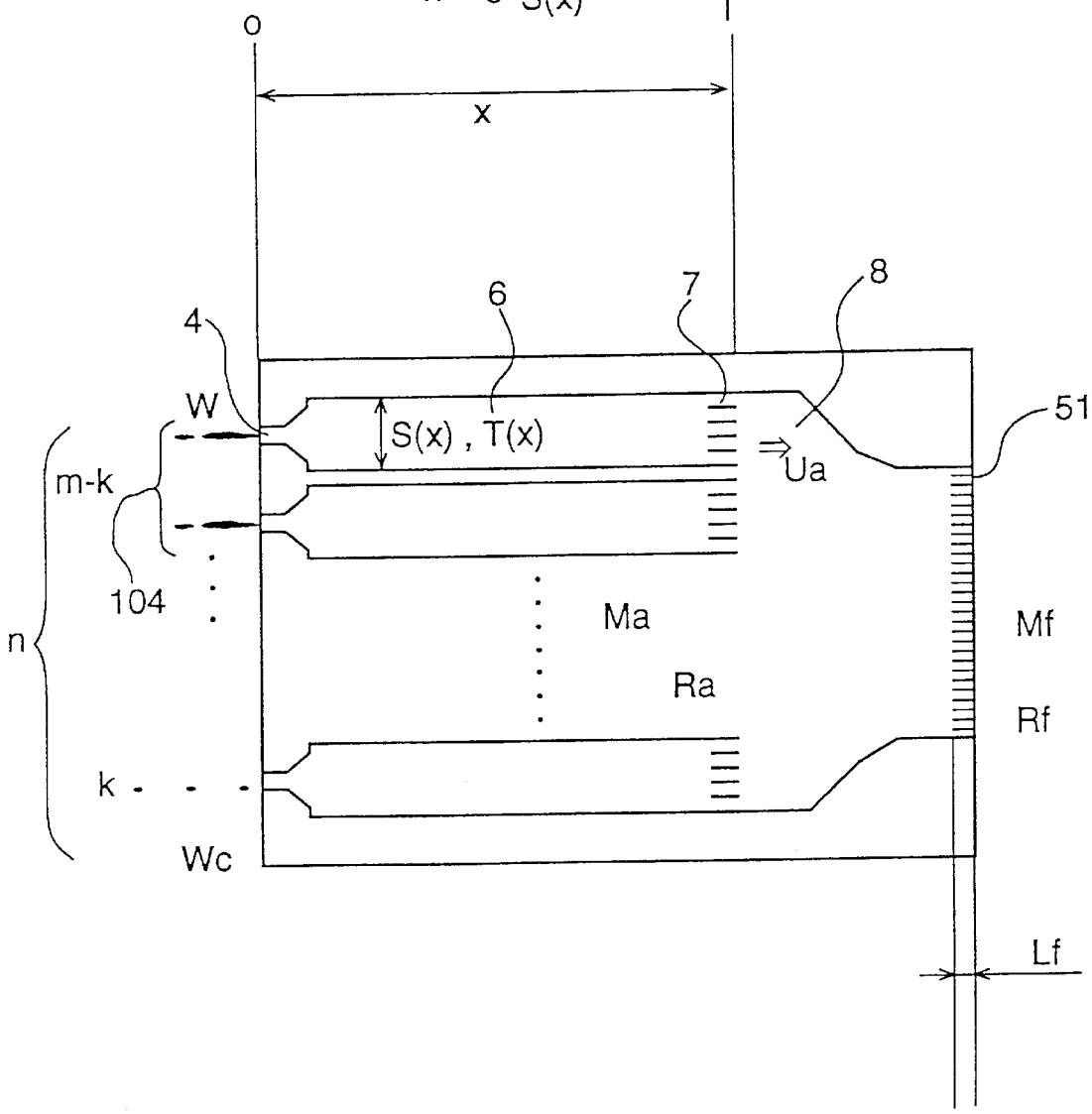
FIG. 7 depicts the various channel constants of the ink passage in an ink jet head according to the preferred embodiment of the present invention.

FIG. 7 is a plan view of the preferred embodiment of the invention, and is used below to describe the channel constants of common ink cavity 8 and filter 51.

The following description is premised upon ejecting ink drops 104 from (n-k) nozzles of an ink jet head comprising n nozzles by driving the actuators disposed in the ejection chambers 6 as described above; k is the number of non-driven nozzles. As described above, the channel constants of common ink cavity 8 and filter 51 are set to prevent ink ejecting from non-driven nozzles due to cross talk.

Simultaneously to the ejecting of ink drop 104 from nozzle 4, some of the ink is returned through orifice 7 to common ink cavity 8.

It is assumed below that: w is the ink volume per eject from one driven nozzle; Ua is the volume velocity of the ink back flowing from orifice 7 of one driven nozzle to common ink cavity 8; n is the number of parallel nozzles 4; Ma is the total inertance of all ink passages in the eject unit from nozzle 4 to orifice 7; Ra is the total flow resistance of the ink passage; Mf and Rf are the inertance and flow resistance, respectively, of the filter 51, these inertance or resistance can be written by;

$$Mf = \frac{\rho Lf}{Sf} \quad [4]$$

$$Rf = \frac{2\eta Tf^2 Lf}{Sf^3} \quad [5]$$

where, Lf is the length of the filter channels 52, Sf is the total cross sectional area of all filter channels 52, and Tf is sum of the cross-sectional circumferences of the filter channels 52.

$$Ma = \frac{\rho}{n}\int_0^{\iota} \frac{1}{S(x)} dx \quad [6]$$

$$Ra = \frac{2\eta}{n}\int_0^{\iota} \equiv \frac{T(x)^2}{S(x)^3} dx \quad [7]$$

where ι is the total length of an ink passage plus associated nozzle, S(x) is the cross sectional area of the ink passage at coordinate x, and T(x) is the cross-sectional circumferences of the ink passage at coordinate x as defined in FIG. 7.

Figure 8:
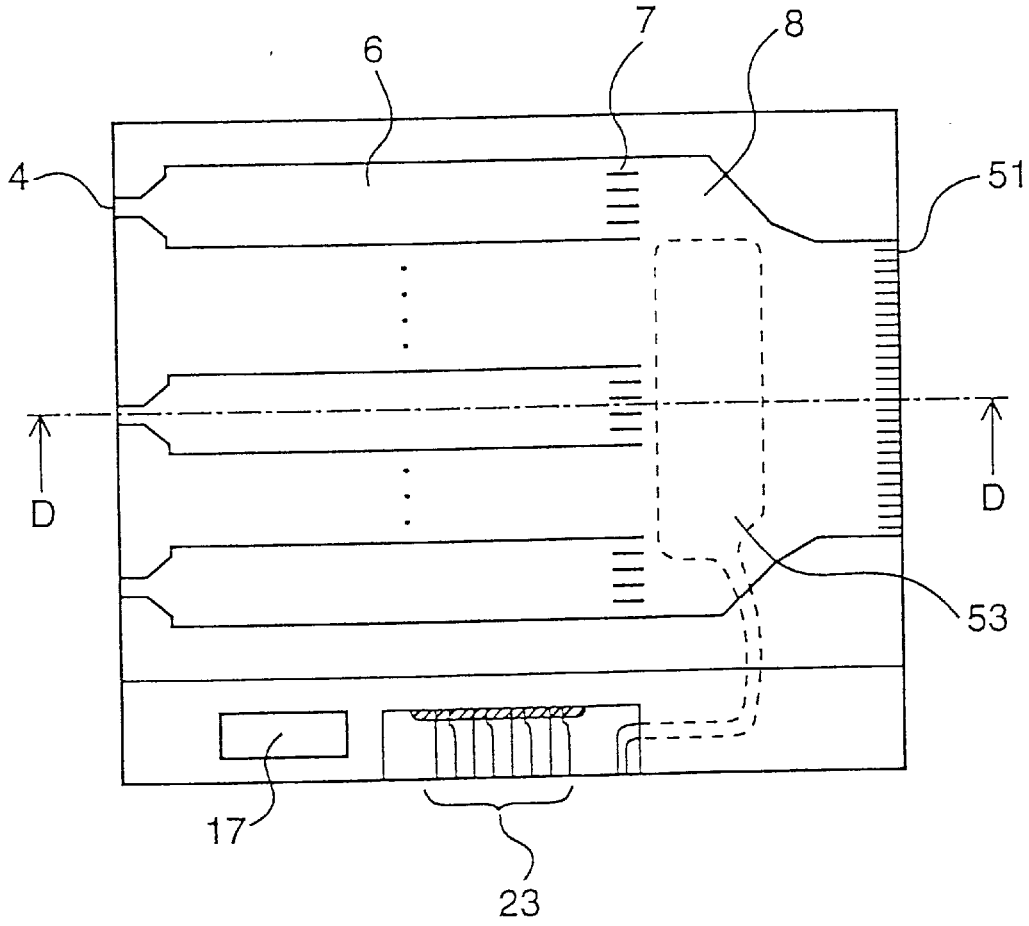
FIG. 8 is a cross-sectional view of an ink jet head according to an alternative embodiment of the invention.

The pressure increase $\delta P_{fk}$ in common ink cavity 8 when ink drop 104 is ejected in the state shown in FIG. 8 is thus:

$$\delta P_{fk} = \frac{n\alpha(n-k)}{n+\alpha k} Ma = \frac{dUa}{dt}. \quad [8]$$

where α is the ratio between the inertance Ma of the complete eject unit and the inertance Mf of the filter, and is α=Mf/Ma; and t is time.

The ink ejection volume from one non-driven nozzle at this time, i.e., the cross talk capacity $w_c$ resulting from the mutual interference between ink passages, is the second integral of the pressure increase $\delta P_{fk}$ in common ink cavity 8 divided by nMa, and is therefore:

$$w_c = \frac{\alpha(n-k)}{n+\alpha k}\beta w \quad [9]$$

where β is a constant determined by the balance between inertance and flow resistance on the nozzle-side of the ink passage, and the inertance and flow resistance on the orifice-side of the ink passage, and is a ratio between the ink volume w per eject from the nozzle and the ink volume back-flowing from the orifice to the common ink cavity. The ratio β is defined as:

$$\beta = \frac{1}{w}\int u_G dt. \quad [10]$$

In an ink jet head with twelve nozzles, n>k and α<1 when there is one non-driven nozzle, and cross talk $w_c$ is:

$$w_c \approx \alpha\beta w \quad [11]$$

To prevent cross talk from occurring in the present embodiment, the relationship between α, i.e., Mf/Ma, and cross talk was experimentally determined (the results are shown in Table 1). Based on these results, the ratio Mf/Ma is set to 0.2 or less, and in sample 4 was 0.121.

When all n nozzles are driven at the highest frequency fd, the channel constants of common ink cavity 8 and filter 51 were determined to prevent any ink supply deficiency.

More specifically, to prevent an ink supply deficiency and the intake of air from the nozzle 4, and assure stable drive, the relationship between α and cross talk must satisfy the equation:

$$nwfd(R_f + R_a) < \frac{\gamma Ta\cos\theta}{Sa} - Ph \quad [12]$$

where: γ is the surface tension of the ink; Ta is the circumference of nozzle 4; Sa is the surface area of nozzle 4; θ(θ≈0) is the contact angle between the ink and head material (e.g., single crystal silicon); and Ph is the pressure added to the ink supply system supplying ink from an external supply to the ink jet head. For example, if the ink tank storing the ink to be supplied to the head is made of a flexible material, deformation of the ink tank applies negative pressure from an external source to the ink jet head; depending on the height relationship (level difference) between the ink jet head and ink tank, a specific positive pressure is also applied externally to the ink jet head. If the flow resistance Rf of common ink cavity 8 and filter 51 is low enough relative to the flow resistance Ra of the complete ink passage to be ignored, an ink supply deficiency resulting from the provision of filter 51 will not occur. Based on the experimental results shown in Table 1, the Rf/Ra ratio is set to a maximum 0.25, and in sample 4 was 0.173.

The results of tests relating to cross talk and ink supply deficiencies using ink jet heads constructed according to the present invention are shown in Table 1. The ink jet head used in these tests had twelve nozzles.

TABLE 1

| | | Sample | | | |
|---|---|---|---|---|---|
| | | 1 | 2 | 3 | 4 |
| Inertance of filter 51 (Mf) | $\times 10^8$ kg/m$^4$ | 0.105 | 0.608 | 0.078 | 0.039 |
| Flow resistance of filter 51 (Rf) | $\times 10^{12}$ Nsec/m$^5$ | 0.318 | 0.383 | 0.021 | 0.100 |
| Ink capacity of common ink cavity 8 (Cr) | $\times 10^{-19}$ m$^5$/N | 7.117 | 2.312 | 8.374 | 2.444 |
| Inertance ratio (Mf/Ma) | % | 17.7 | 18.1 | 34.3 | 12.1 |

TABLE 1-continued

| | | Sample | | | |
|---|---|---|---|---|---|
| | | 1 | 2 | 3 | 4 |
| Flow resistance ratio (Rf/Ra) | % | 24.1 | 38.5 | 3.8 | 17.3 |
| Ink capacity ratio (Cr/Ca) | % | 45.7 | 19.8 | 35.2 | 10.4 |
| Results | | | | | |
| Cross talk (pressure interference between ink passages) | | ○ | ○ | x | ○ |
| Supply deficiency (poor response, inconsistent ejecting) | | ○ | x | ○ | ○ |
| Ink ejection volume w | μg/dot | 0.093 | 0.128 | 0.153 | 0.165 |

○: good
x: unacceptable (problems detected)

Inconsistent ink ejection caused by supply deficiencies during high frequency drive were observed with sample 2 in Table 1. When eleven nozzles were driven and one was non-driven as in sample 3, ink eject from the non-driven nozzle was also observed. No cross talk or supply deficiencies were observed with samples 1 and 4. The greatest per-eject ink volume w was observed with sample 4, which yielded the best ink eject characteristics. Sample 4 had 58 filter holes, each 45 μm wide and 50 μm long.

Figure 9:
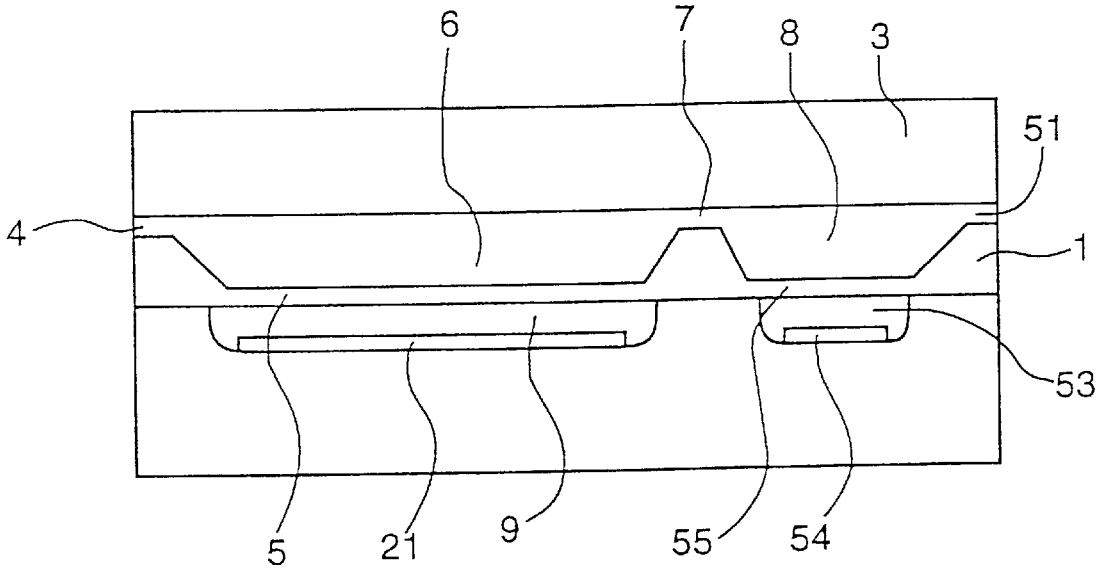
FIG. 9 is a cross-sectional view taken along line D—D in FIG. 8.

FIG. 8 is a plan view of an alternative embodiment of the invention. FIG. 9 is a cross-sectional view taken along line D—D of FIG. 8. The embodiment shown in FIG. 8 comprises plural parallel ink passages, only part of which is shown.

As shown in FIGS. 8 and 9, this embodiment comprises a pressure buffer chamber 53, which is a space formed below the ink supply unit; a transparent oxide conductive film 54 formed inside pressure buffer chamber 53 from the same ITO material as individual electrodes 21; and buffer wall 55 corresponding to the bottom wall of the ink supply unit and having the same thickness as diaphragm 5. The pressure increase in common ink cavity 8 created when ejection chamber 6 in the ink passage is driven is absorbed, buffered, and effectively cancelled by buffer wall 55. This construction prevents pressure interference between ink passages and ink supply deficiencies caused by providing filter 51.

The primary reason for providing transparent oxide conductive film 54 is to prevent buffer wall 55 from adhering to second substrate 2 and becoming nonfunctional when substrate 1 and second substrate 2 are anodically bonded.

When the ink capacity (compliance) of common ink cavity 8 is sufficiently great, the pressure created by the driven nozzles and transferred to common ink cavity 8 can be buffered by the ink compliance alone. By actively disposing buffer wall 55 as in this embodiment, sufficient compliance can be obtained even with a small capacity common ink cavity 8, and the pressure generated in common ink cavity 8 during ink jet head drive can be sufficiently buffered. Providing buffer wall 55 also increases the range of channel constants available to filter 51, i.e., by providing buffer wall 55, pressure can still be buffered and cross talk therefore does not occur even if the inertance of filter 51 is high relative to the total inertance of the ink passage.

It is to be noted that the force of electrostatic attraction is used as the pressure generating means in the above embodiments, but, as will be appreciated by one skilled in the art, it is also possible to provide a piezoelectric element as the pressure generating means on the side of diaphragm 5 opposite ejection chamber 6. In this case an appropriate voltage is applied to the piezoelectric device to deform the diaphragm. The pressure generating means may alternatively comprise a resistance heating element disposed in ejection chamber 6 such that the pressure ejecting the ink is created by the thermal expansion of the ink induced by the resistance heating element. It is to be further noted that the action and effect of the present invention are the same irrespective of the type of pressure generating means used.

While the pressure generating means of the invention shall not be limited to a means using the force of electrostatic attraction, high ink pressure can be obtained, depending on the gap, by using electrostatic attraction as the pressure generating means, and the head construction can be simplified. In addition, the greatest benefit can be obtained from the present invention when electrostatic attraction is used for the pressure generating means.

Figure 10:
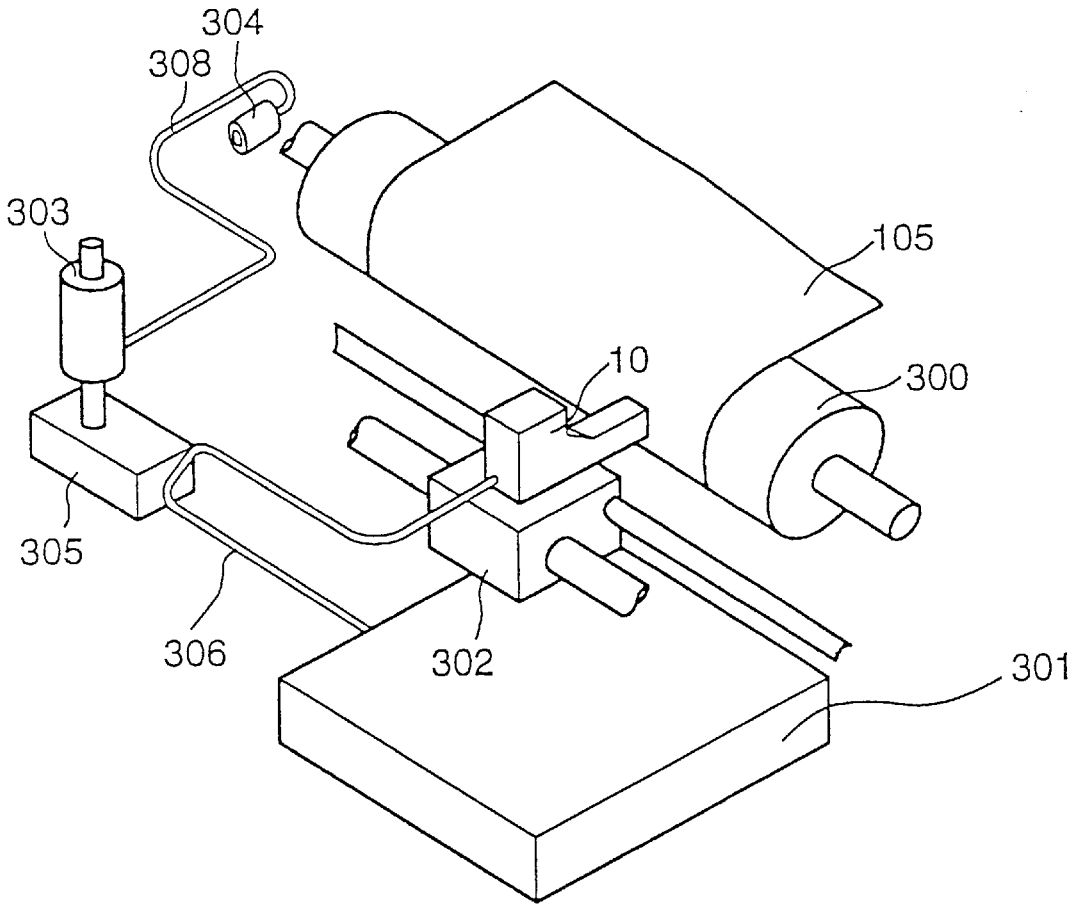
FIG. 10 is a schematic diagram of an ink jet recording apparatus according to the present invention.

FIG. 10 is a schematic view of an ink jet recording apparatus according to the present invention comprising the above ink jet head 10. Platen 300 transports recording paper 105, and ink tank 301 stores the ink internally for supplying ink to ink jet head 10 through ink supply tube 306. Carriage 302 reciprocally moves ink jet head 10 in the direction perpendicular to the transport direction of recording paper 105. The desired text and graphics can be printed to paper 105 by the drive circuit 40 ejecting ink drops 104 from ink jet head 10 at the appropriate timing while driving the carriage 302. Pump 303 functions to suction ink through cap 304 and waste ink recovery tube 308 for recovery to waste ink reservoir 305 when there is an ink eject defect or other problem in ink jet head 10, and when the ink is replaced.

Inclusion of filter in ink jet head 10 in the ink jet recording apparatus according to the present invention prevents the penetration of foreign particulate to ink jet head 10, thereby eliminating the need to provide a filter inside ink tank 301 and ink supply tube 306, and simplifying the ink supply system. In addition, only ink jet head 10 is disposed on carriage 302 in the present embodiment, but the invention shall not be so limited and the same desirable effects can be obtained whether the ink tank is disposed on the carriage, or whether a disposable ink jet head integrating the ink tank with the printer head is used (in which case the complete ink jet head is thrown away when the ink tank is emptied of ink).

The manufacturing method of an ink jet head according to the present invention is described below with reference to FIGS. 11A–11D, 12, 13 and 14.

Figure 11A:
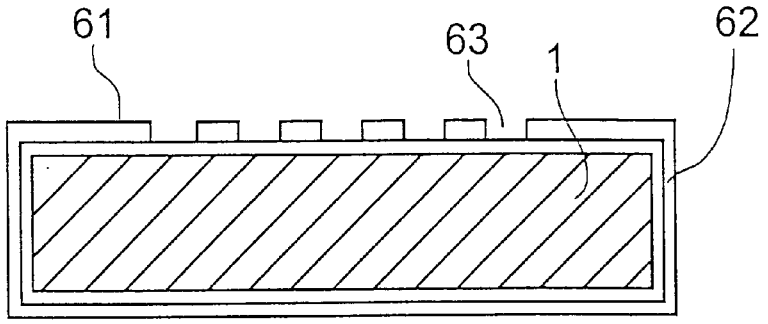
FIGS. 11A–11D depict the process of the manufacturing method according to the present invention for forming the channels in substrate 1.
Figure 11B:
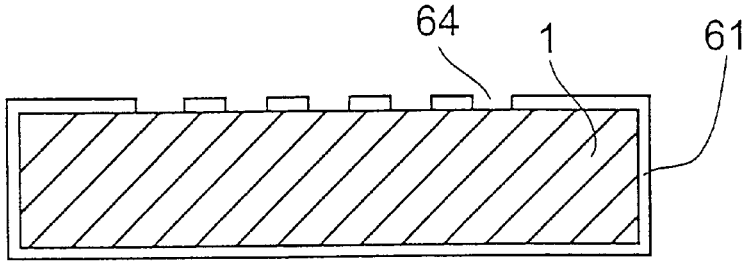

FIGS. 11A–11D describe the process of this manufacturing method for forming the channels in substrate 1. FIGS. 11A–11D each show cross-sectional views of the part of the ink jet head to which the filter channels 52 are formed in substrate 1. As shown in FIG. 11A, a $SiO_2$ thermal oxidation film 61 is formed to a thickness of 6000 Å by thermal oxidation at 1100° C. to the surface of substrate 1, which is single crystal Si. A resist film 62 is then formed by coating the surface of substrate 1 with a photosensitive resin.

Referring again to FIG. 11A, after resist film 62 is coated to and dried on the surface of substrate 1 coated with the $SiO_2$ thermal oxidation film, a positive mask describing the pattern of filter channels 52 is used to expose the resist film 62 with ultraviolet light. The resist film 62 is then developed, rinsed, and dried to form the filter channel 52 pattern. The line width of the filter channel 52 pattern is made narrower than the line width of the pattern for forming nozzle channels 11 and orifice channels 13.

The oxide film is then etched using a BHF etching solution of 1:6 (volume ratio) hydrofluoric acid and ammonium fluoride. This etching process removes the oxide film in the pattern forming filter channels 52. Resist film 62 is then peeled away, resulting in the state shown in FIG. 11B. The oxide film used for the pattern of the channels forming the ink passages and ink supply unit is also removed at this time.

Figure 11C:
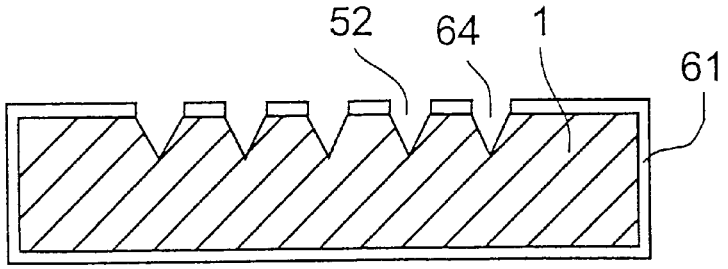

The single crystal Si of substrate 1 is then etched using an aqueous solution of potassium hydroxide (KOH) and ethanol. As described above, the etching speed of face (100) of single crystal silicon is 40 times faster than that of face (111), and face (111) is therefore exposed by this etching process. FIG. 11C shows the substrate after single crystal silicon etching. At this time, filter channels 52 are formed by only faces (111) of the single crystal Si.

Because filter channels 52 are formed by the relatively slow etching speed faces (111), there is virtually no etching of these faces (111), and the filter channels 52 can be formed with a consistent width and depth controlled by the line width of the mask pattern. The other ink passage and ink supply unit channels can be similarly formed with high precision.

Figure 11D:
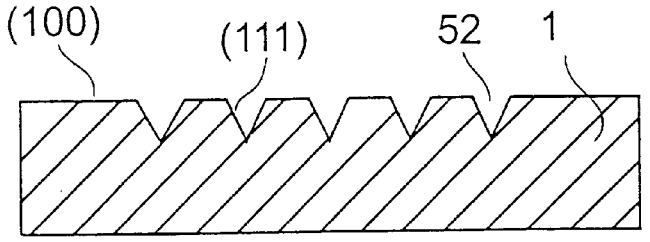

After forming the channels, the substrate is washed with hot sulfuric acid, then vapor washed with isopropyl alcohol, and the thermal oxidation film on the surface is removed with BHF. FIG. 11D shows the completed channels after removing the thermal oxidation film. A protective thermal oxidation film is then formed again on substrate 1 to complete substrate 1.

Figure 12:
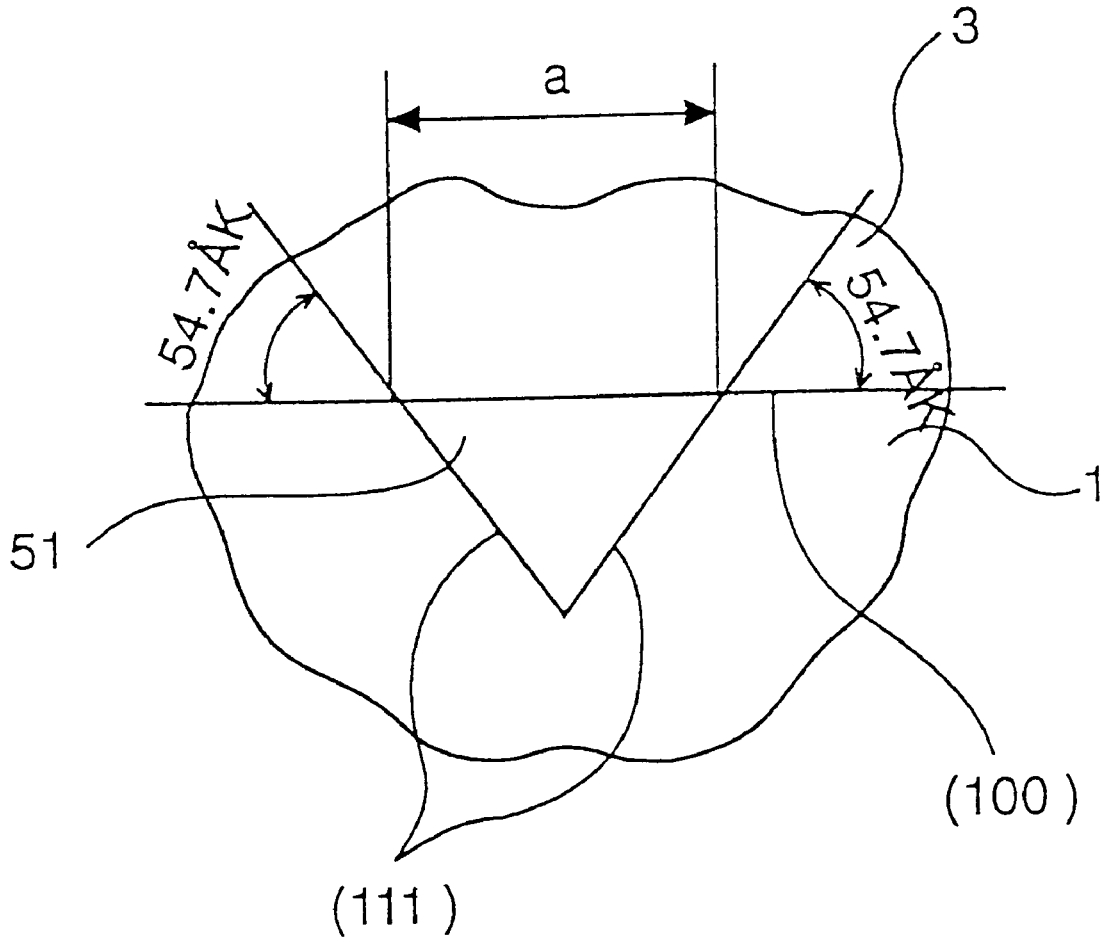
FIG. 12 is an enlarged view of an exemplary filter of the ink jet head according to the preferred embodiment of the present invention.
Figure 13:
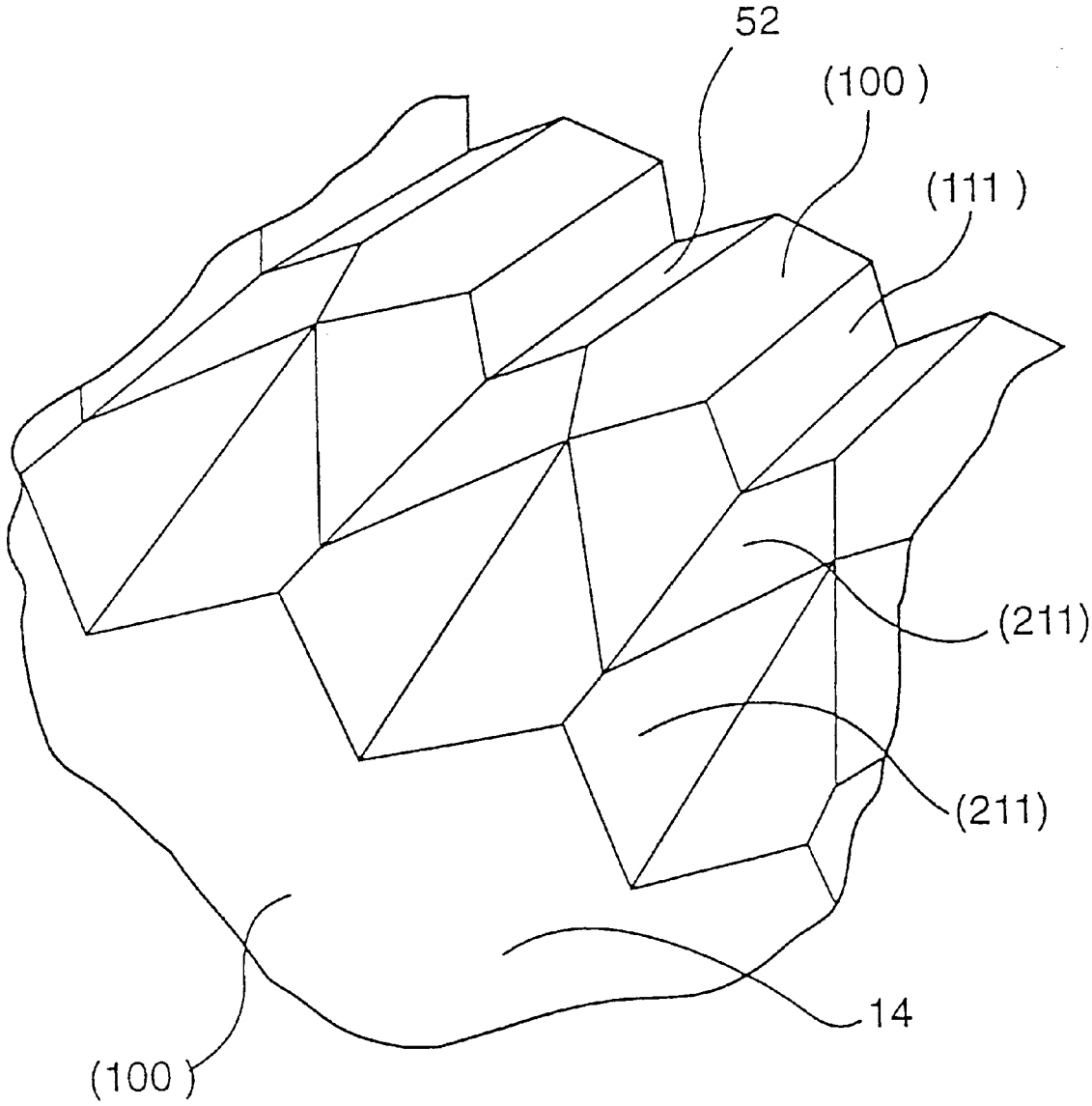
FIG. 13 is an enlarged perspective view of the filter channels in an ink jet head according to the present invention.

FIG. 12 is an enlarged view of an exemplary filter 51 in the direction of arrow A in FIG. 4. FIG. 13 is an enlarged perspective view of filter channels 52 after etching as seen from the recess 14. Filter 51 are formed by etching filter channels 52, bonding the first, second, and third substrates 1, 2, and 3 together, and then slicing the substrates to expose the filter. As a result, the filter has a triangular cross section comprising two single crystal Si (111) faces and one (100) face, which is the face used to bond the substrates together. By thus comprising the filter channels with a triangular cross section comprising crystal faces etched at a relatively slow etching speed and a common intersecting crystal face, the filter can be obtained easily and with high precision.

As can be appreciated by one of ordinary skill in the are, while the device in this example is fabricated with single crystal silicon as substrate 1, germanium, single crystal silicon oxide (quartz), or other materials enabling anisotropic etching may be used. Single crystal silicon is readily obtainable as a semiconductor material, and quartz and germanium are available as high purity crystals enabling high precision processing.

A method for mass manufacturing ink jet heads is described below. This method batch processes plural groups of ink passages to a single silicon wafer of substrate 1 using a single pattern; similarly batch processes the second and third substrates with the positions and number of pattern elements coordinated with substrate 1; laminating these three substrates together; and then slicing the laminated wafers into plural ink jet heads.

Figure 14:
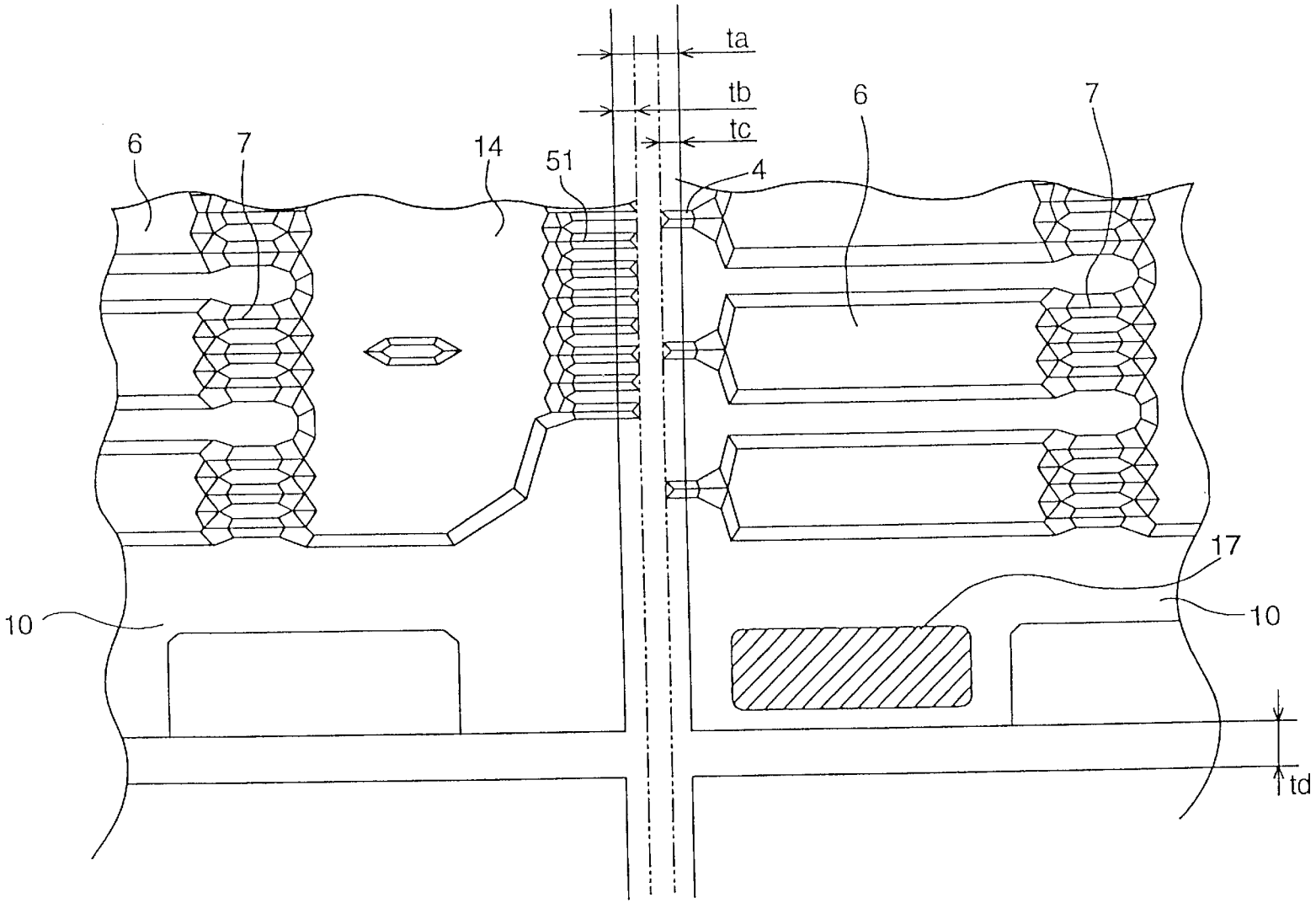
FIG. 14 is a pattern diagram showing the cutting margins between plural ink passage patterns formed by anisotropic etching to a silicon substrate.

FIG. 14 shows the pattern of the places sliced to separate the individual ink jet heads after anisotropic etching of plural sets of ink passage patterns to a single silicon wafer. This slicing pattern is formed as part of the line pattern described above. The patterns for ink jet heads 10 and 10' separated by slicing are formed with the nozzles 4 and filter 51 mutually opposed. After bonding substrates 2 and 3 to substrate 1, the slicing margin $t_a$ of adjacent patterns is removed to separate the individual ink jet heads. The filter 51 pattern overlaps the slicing margin $t_a$ by margin $t_b$, and the nozzle 4 pattern overlaps the slicing margin $t_a$ by margin $t_c$.

For example, when the ink jet heads are sliced apart and separated in the dicing process, a grinding stone slightly narrower than the slicing margin ta is used to cut apart the ink jet heads referenced to the filter 51 side. The nozzles 4 are then polished, and post-processed for water repellence, etc.

This manufacturing method enables the batch production of plural ink jet heads, and makes it possible to easily manufacture ink jet heads at low cost. Because the cross-sectional area of the filter 51 openings is the smallest part of the head externally exposed, it is possible to prevent the penetration of foreign particulate from the manufacturing process into the ink jet head by cutting the filter channels to form the heads. This also reduces manufacturing defects, and thus increases ink jet head production yield.

Various means of cutting the ink jet heads apart can be used, including: abrasive grinding by dicing, scribing and then breaking, laser scribing, and cutting by a water jet. More specifically, abrasive grinding by dicing enables cutting with relatively good precision. Dicing also makes it possible to assure the length of filter 51 with good precision. Scribing and then breaking is the easiest and quickest method of cutting the ink jet heads apart, and is suited to mass production. Laser scribing does not produce chips from cutting, and has the lowest probability of causing clogging as a result of the manufacturing process. Cutting by a water jet is the most resistant to side effects from heat.

It is to be noted that whichever cutting method is used there is no difference in the obtained benefits because the filter 51 are formed by first etching filter channels, bonding the substrates together, and then cutting to expose the opening of the filter channels forming the filter.

By means of the invention thus described, it is possible to prevent clogging of the ink passage due to the penetration of foreign particulate, and it is thereby possible to obtain a high reliability ink jet head with no missing dots. It is also possible to provide a high print quality ink jet head and ink jet recording apparatus because there is no pressure interference between ink passages, thereby eliminating ink supply deficiencies and enabling consistent ink ejecting.

Manufacturing is also simple, and a low cost, dimensionally precise, high quality ink jet head can be obtained.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. An inkjet head which comprises:

an ink supply port;

a common ink cavity in connection with said ink supply port, wherein said common ink cavity is defined by at least a wall;

a plurality of ink supply passages, each in communication with said common ink cavity;

a plurality of ink ejection nozzles each in communication with a respective one of said plurality of ink supply passages;

a corresponding plurality of pressure generators respectively associated with each of said plurality of ink supply passages, said plurality of pressure generators being selectively drivable to eject ink droplets through respective ones of said plurality of ink ejection nozzles;

wherein a portion of said wall is flexible.

2. The inkjet head according to claim 1, further comprising a filter having a plurality of filter channels having a first end and a second end, wherein the first end communicates with said ink supply port and the second end communicates with said common ink cavity.

3. The inkjet head according to claim 2, further comprising an anisotropic crystalline substrate, wherein said plurality of ink ejection nozzles, said plurality of ink supply passages, said common ink cavity and said filter are disposed on said anisotropic crystalline substrate.

4. The inkjet head according to claim 3, wherein said anisotropic crystalline substrate comprises a single crystalline silicon.

5. The inkjet head according to claim 1, further comprising a hollow chamber separated from said common ink cavity by said portion of said wall.

6. The inkjet head according to claim 1, wherein each of said plurality of pressure generators comprises a corresponding electrostatic actuator comprising a diaphragm forming a wall portion of a respective one of said plurality of ink supply passages and an electrode provided opposite to said diaphragm, wherein said electrode is separated from said diaphragm by a gap.

7. The inkjet head according to claim 1, wherein each of said plurality of ink supply passages comprises a corresponding wall portion forming a diaphragm and each of said plurality of pressure generators comprises a respective piezoelectric element attached to a respective diaphragm.

8. The inkjet head according to claim 1, wherein each of said plurality of pressure generators comprises a corresponding electrically drivable heating element disposed in a respective one of said plurality of ink supply passages.

* * * * *